US007822325B2

(12) United States Patent
Murphy et al.

(10) Patent No.: US 7,822,325 B2
(45) Date of Patent: Oct. 26, 2010

(54) WATER HEATER AND METHOD OF CUSTOMIZING THE WATER HEATER

(75) Inventors: Mark Allan Murphy, Nashville, TN (US); Jeffrey Ray Baxter, Columbia, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 353 days.

(21) Appl. No.: 11/943,402

(22) Filed: Nov. 20, 2007

(65) Prior Publication Data

US 2009/0126652 A1 May 21, 2009

(51) Int. Cl.
*A47J 27/00* (2006.01)

(52) U.S. Cl. ..... 392/441; 392/463; 219/494

(58) Field of Classification Search ..... 392/441, 392/463

See application file for complete search history.

(56) References Cited

U.S. PATENT DOCUMENTS 4,217,483 A 8/1980 Vogel et al.
4,348,668 A 9/1982 Gurr et al.
4,751,605 A 6/1988 Mertz et al.
5,103,078 A 4/1992 Boykin et al.
5,113,480 A 5/1992 Murphy et al.
5,504,306 A 4/1996 Russell et al.
5,575,194 A 11/1996 Maher, Jr. et al.
5,588,636 A 12/1996 Eichholz et al.
5,948,304 A 9/1999 Bradenbaugh
5,956,462 A 9/1999 Langford
6,271,505 B1 8/2001 Henderson
6,286,764 B1 9/2001 Garvey et al.
6,356,426 B1 3/2002 Dougherty
6,522,937 B2 2/2003 Ette et al.
6,633,726 B2 10/2003 Bradenbaugh
6,707,030 B1 3/2004 Watson
6,795,644 B2 9/2004 Bradenbaugh
6,936,798 B2 8/2005 Moreno

*Primary Examiner*—Thor S Campbell
(74) *Attorney, Agent, or Firm*—Michael Best & Friedrich LLP

(57) ABSTRACT

A water heater including a vessel, a heating fixture (e.g., an electric-resistance heating element, a gas burner) having a rated maximum heating output, and a controller. The controller includes an interface and a temperature sensor. The controller can control the heating output of the heating element based on a sensed temperature of the temperature sensors. The heating output is a defined maximum heating output for the heating fixture. Also disclosed are methods of defining the capabilities of a water hater heater and methods of operating a water heater.

22 Claims, 4 Drawing Sheets

WATER HEATER AND METHOD OF CUSTOMIZING THE WATER HEATER

FIELD OF INVENTION

The invention relates to water heaters and methods for controlling water heaters. More particularly, the invention relates to, among other things, controlling a heating element of a water heater to generate a desired heating output.

SUMMARY

In one embodiment, the invention includes customizing a generic water heater model, thus selectively adapting the functionality of one or more features of the water heater for an end user (e.g., merchandiser, retailer, customer, etc.). For example, the invention can include enabling or disabling certain features of a generic water heater to provide an end user with desired functionality. As another example, the invention can include controlling a heating element of the water heater to generate a predetermined heating output tailored to a specific or desired application. The customizing of a generic water heater allows the manufacturer, for example, the ability to enable a reduction in the number of end models, and thereby reduce the necessary total inventory of water heaters (for example, reducing an inventory in a manufacturer's warehouse).

In one embodiment, the invention provides a water heater including a vessel adapted to support water to be heated, a heating fixture having a rated maximum heating output, and a controller configured with a value indicative of a defined maximum heating output and to control the heating fixture to generate the defined maximum heating output. The controller has an interface operable to receive the defined maximum heating output.

In another embodiment, the invention provides a method of defining the capabilities of a water heater including a controller and an electric resistance heating element having a rated maximum heating output. The method includes providing a vessel adapted to support water to be heated with the heating element, connecting the controller to the heating element, and setting the controller to a defined maximum heating output thereby limiting the heating output of the heating element to be equal or less than the defined maximum heating output during operation.

In yet another embodiment, the invention provides a method of operating a water heater for heating water. The water heater has an electric-resistance heating element with a rated maximum heating output. The heating element is coupled to a controller configured to control the heating element to a defined maximum heating output less than the rated maximum heating output. The method includes sensing a temperature having a relation to a water temperature, determining whether to heat the water based on the temperature, and powering the heating element to the defined maximum heating output based on the determining act.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

In addition, it should be understood that embodiments of the invention include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. Similarly, some embodiments of the present invention described herein operate utilizing software. One of ordinary skill in the art, and based on a reading of this detailed description, would recognize that, in at least one embodiment, such embodiments could instead operate without software, instead utilizing electronic circuitry and other hardware configured to perform the same functions. As such, it should be noted that any number and combination of hardware-based devices, software-based devices, and structural components may be utilized to implement the various embodiments of the present invention. Also, although various components of the present invention are described and illustrated herein as being defined by modules, it will be appreciated that the modules described and illustrated herein can be configured in a significantly different manner, can be defined by one or more other modules performing additional tasks, and/or can be defined by fewer modules.

Figure 1:
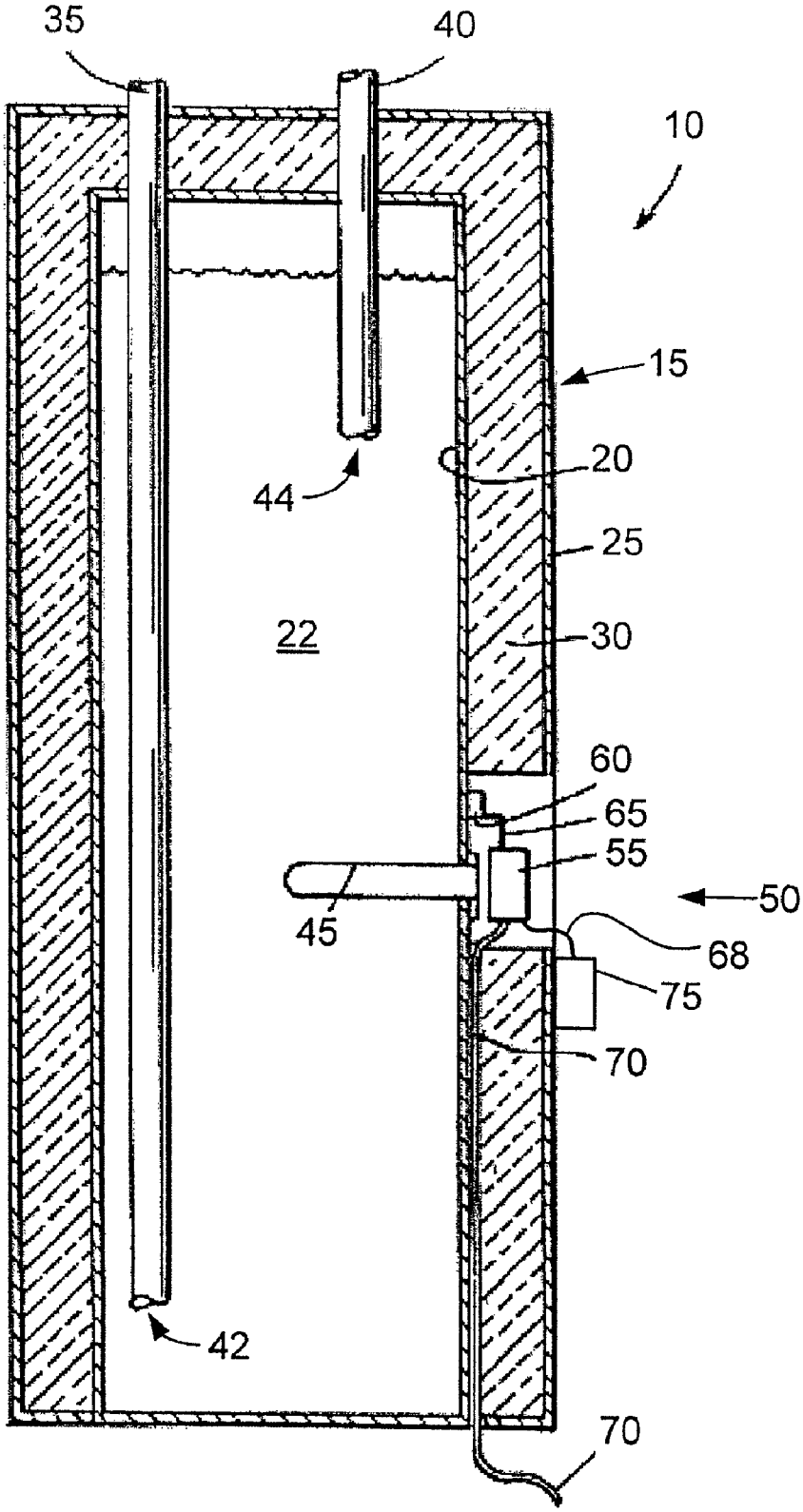
FIG. 1 is a representation of an exemplary water heater incorporating an embodiment of the invention.

FIG. 1 illustrates one exemplary construction of a water heater 10 according to one embodiment of the invention. The water heater 10 comprises a vessel 15 including an enclosed water tank 20 defining an inner space 22, and a shell 25 surrounding the water tank 20. In the illustrated construction, a foam insulation layer 30 fills the annular space between the water tank 20 and the shell 25. A water inlet line or dip tube 35 and a water outlet line or dip tube 40 extend from the top of water tank 20 to the inner space 22. The water inlet line 35 includes an inlet opening 42 for supplying cold water in the inner space 22 near the bottom of the water tank 20. The water outlet line 15 includes an outlet opening 44 for withdrawing relatively hot water from the inner space 22 near the top of water tank 20. While the vessel 15 illustrated in FIG. 1 includes characteristics of a vessel for a storage-type water heater, aspects of the invention can apply to other types of water heaters (e.g., a flow-through or instantaneous-type water heater), which may or may not include some of the components shown and described herein.

The water heater 10 can include one or more heating fixtures for heating the water within the vessel 15. In the illustrated construction, the water heater 10 includes one heating fixture illustrated as an electric resistance heating element 45 at least partially disposed within the water tank 20. Other constructions of the water heater 10 can include other types of heating fixtures (e.g., a gas burner) and other designs for the heating element 45 can be used for some aspects of the invention. The heating element 45 is connected to a power source and a controller 50.

The water heater 10 includes the controller 50 for controlling the heating output of the heating fixtures. For the particular construction illustrated in FIG. 1, the controller 50 is operable to control the heating output of the heating element 45. As illustrated in FIG. 1, the controller 50 is mounted on a side wall of the vessel 15 and includes circuitry (e.g., control circuit 100 illustrated in FIG. 2) at least partially enclosed in a control box 55. In the illustrated construction, the circuitry is operable to relay power to the heating element 45. For example, electric alternating current power is supplied through line 70 and the circuitry to the heating element 45. The circuitry is also operable to sense characteristics of the power supplied to the heating element 45, characteristics of the water in the vessel 15, and other characteristics of the water heater 10.

The controller 50 also includes a temperature sensor 60 (e.g., a thermistor) mounted on the water tank 20 to sense a temperature related to the temperature of the water within the vessel 15. In the illustrated construction, the temperature sensor 60 is connected to the circuitry within the control box 55 with an electrical wire 65. The number of temperature sensors, the temperature sensor designs, the object sensed by the temperature sensor, and the technique for determining a relation to the water temperature can vary from the construction described herein. The controller 50 also includes an interface 75 illustrated in FIGS. 1 and 5. The interface 75 is connected to the circuitry in control box 55 via a wire 68 and mounted on the shell 25 of the water heater 10 near the control box 55. In other constructions, the interface 75 can communicate with the circuitry in the control box 55 wirelessly, for example, allowing the interface 75 to be placed on the water heater 10 but remotely from the control box 55. The interface 75 allows an operator (e.g., a technician or an owner) to interact with the controller 50.

Figure 5:
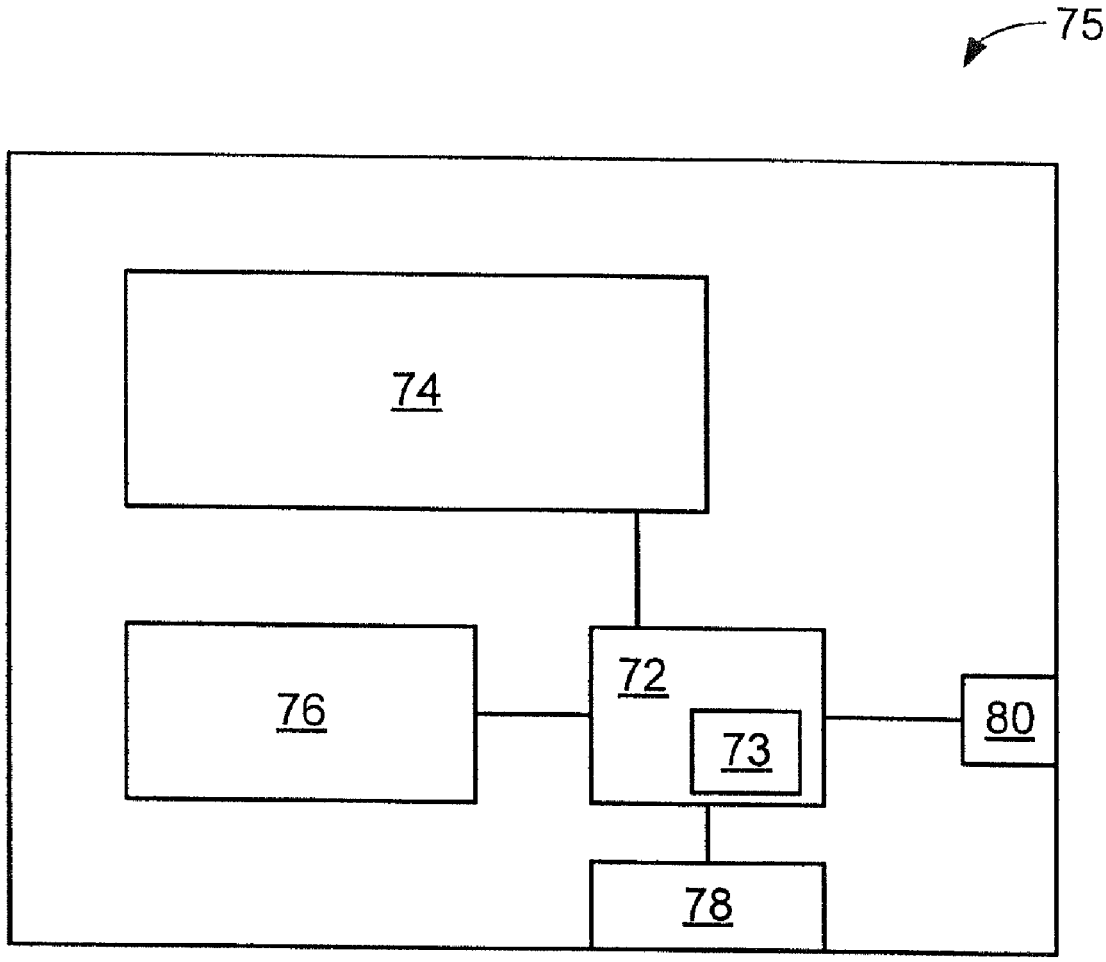
FIG. 5 is a block diagram representing an interface capable of being used in the water heater of FIG. 1.

As illustrated in FIG. 5, the interface 75 includes a microcontroller 72 (or a similar programmable device) with a memory 73. The microcontroller 72 is operable to control a display 74 and a user input panel 76. The input panel 76 can include a number of buttons, dials, knobs, or other suitable elements to allow a user to enter and/or adjust information such as temperature settings, time settings, etc. The interface 75 also includes an input/output layer 78 connected to the controller 72 and operable to send and receive signals via a wired connection, for example. In some constructions, the input/output layer 78 can include wire interfaces for USB cables, phone cables, Ethernet cables, serial cables, and others. The input/output layer allows the interface 75 to communicate with devices such as a portable computer or a handheld device. The interface 75 can also include a wireless communication layer 80 allowing the interface 75 to send and receive information to and from a wireless device. For example, the wireless communication layer 80 can enable the interface 75 to communicate to other wireless devices via protocols such as Wi-Fi, Bluetooth, IrDA, and others. It is to be understood that the interface 75 illustrated in FIG. 5 is for illustration purposes. Accordingly, other configurations of the interface 75 fall within the scope of the invention.

In one alternative construction of the water heater 10, the temperature sensor 60 and the heating element 45 are connected directly to the interface 75 via the input/output layer 78 such that the interface 75 is operable to control the operation of the water heater 10. More specifically, the interface 75 can be configured to sense the temperature of the water in the vessel 15 and can include instructions or means to operate the water heater 10 (stored in the memory 73, for example) based on the temperature sensed by the temperature sensor 60. In this particular construction, the water heater 10 can include other sensors (e.g., humidity sensor, voltage sensors, current sensors) connected directly to the interface 75 and providing signals processed by the microcontroller 72 to operate the water heater 10. In addition, the microcontroller 72 can include further instructions stored in the memory 73 allowing a user to operate other aspects of the water heater 10 via the interface 75.

Figure 2:
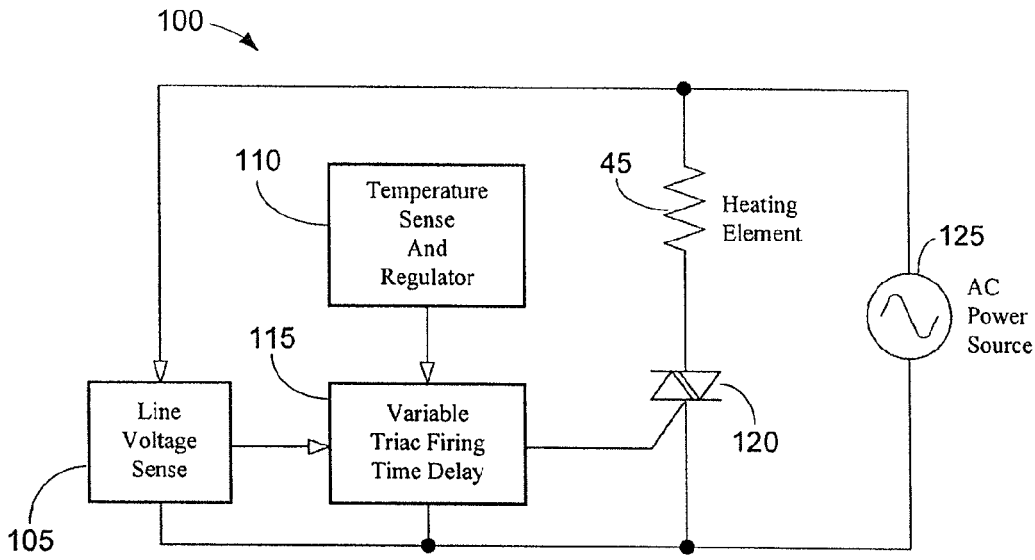
FIG. 2 is a schematic representation of a control circuit operable to control the water heater illustrated in FIG. 1.

FIG. 2 illustrates an exemplary control circuit 100 for controlling the power supplied to the heating element 45. The control circuit 100 is generally placed within the control box 55 and includes a voltage sense circuit 105, a temperature sense circuit 110, a triac control circuit 115, and a triac 120 connected to the heating element 45 for controlling power supplied to the heating element 45 from a power source 125. More specifically, the triac 120 is operable to control the supply of a variable amount of power based on the operation of the control circuit 100.

Figure 3:
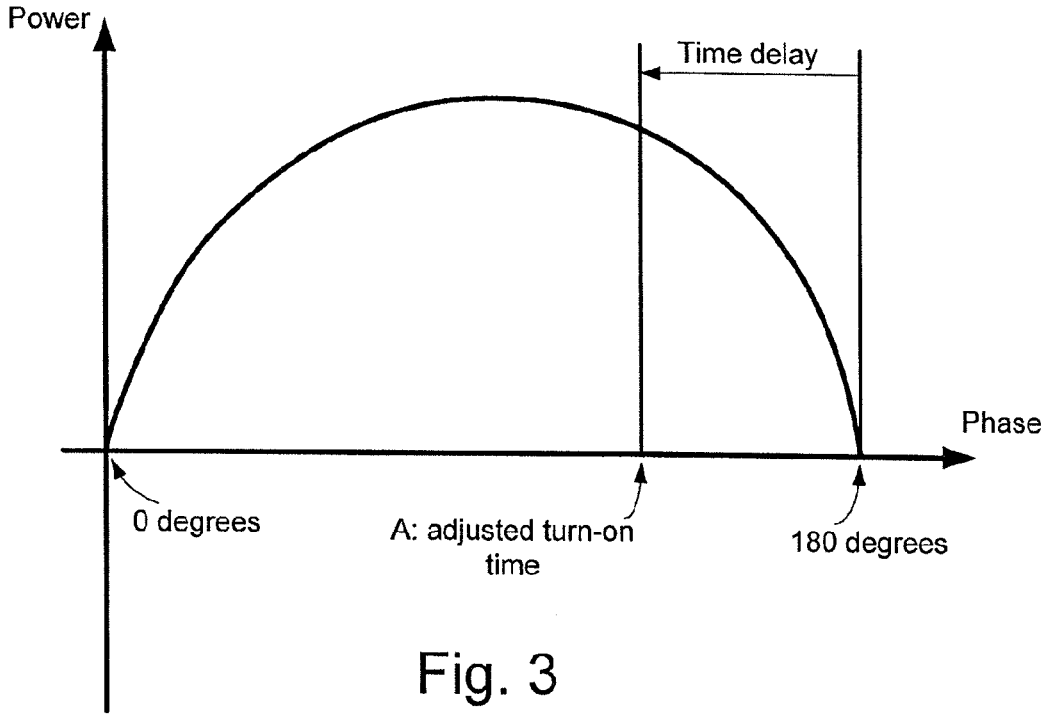
FIG. 3 is a graph representing the half cycle of a line voltage.

In some constructions, the control circuit 100 operates the triac 120 based on a phase control method. With the phase control method, at least a portion of each half cycle of the line power is applied to the heating element 45. For example, FIG. 3 schematically illustrates a half cycle defined between 0 degrees and 180 degrees of a sine wave. If the full 180 degrees of each half cycle is applied to the heating element 16, then full power is transferred to the heating element 45 by the power source 125. Alternatively, the phase control method allows adjusting the amount of power transferred to the heating element 45 based on the amount of the half cycle delivered by the triac 120. More particularly, the control circuit 100 determines a turn-on time of the triac 120 adjusted back from the zero crossing (180 degree-mark in FIG. 3) of the applied voltage to an adjusted turn-on time (point A in FIG. 3). The power supplied to the heating element 45 depends on the portion of the half cycle between the adjusted turn-on time and the zero crossing corresponding to the 0 degree-mark in FIG. 3. As shown in FIG. 3, the difference in the horizontal axis between the 180 degree-mark and A (adjusted turn-on time) is described as a time delay or an angle delay. Accordingly, for the purposes of this application, time delay and angle delay can be used interchangeably.

In another construction, the control circuit 100 can include a burst control circuit for providing power to the heating element 45 in bursts. The details of one burst control circuit are described in U.S. Pat. No. 6,633,726, entitled METHOD OF CONTROLLING THE TEMPERATURE OF WATER IN A WATER HEATER, issued Oct. 14, 2003, the disclosure of which is incorporated herein by reference. It is within the scope of the invention, however, that other suitable methods to control or operate a heating element of a water heater to generate a desired heating output are possible.

In one mode of operation of the control circuit 100, the temperature sensor 60 is operable to sense the temperature of the water tank 20, which is related to the water temperature. The temperature sensor 60 is connected to the temperature sense circuit 110, such that the temperature sense circuit 110 can compare the sensed temperature to a predetermined temperature. Based on the comparison between the temperature sensed by the temperature sensor 60 and the predetermined temperature, the temperature sense circuit 110 can send a signal to the triac control circuit 115 indicating whether or not the water in the vessel 15 needs to be heated. The voltage sense circuit 105 senses the power supplied by the power source 125 and senses the zero crossings of the applied line voltage, such as the zero crossings at the 0 degree and 180 degree marks in FIG. 3. The sense circuit 105 sends a signal to the triac control circuit 115 related to the sensed zero crossings. The triac control circuit 115 is operable to determine a delay time (e.g., the time delay shown in FIG. 3), and therefore a percentage of the total power supplied to the heating element 45, based on the signals generated by the temperature sense circuit 110 and the voltage sense circuit 105.

Figure 4:
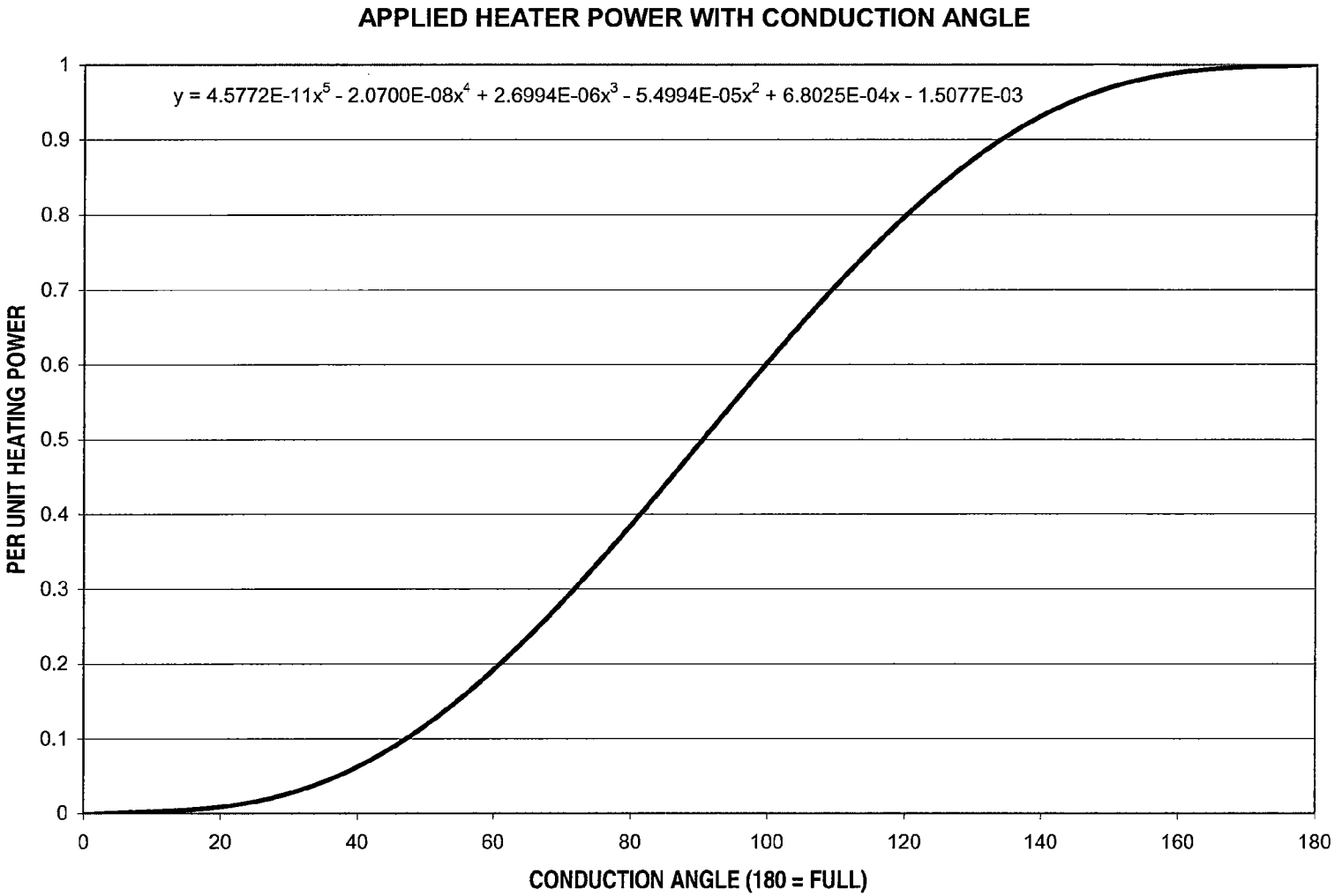
FIG. 4 is a graph of a power transfer function as a function of conduction angle.

FIG. 4 shows a graph 200 indicating per unit heating power as a function of the angle delay determined by the control circuit 100. The graph 200 illustrates an experimentally determined power transfer function relating the heating power generated by the heating element 45 to the angle delay applied to the power supply by the triac 120. The power transfer function is as follows:

$$Y=4.5772e^{-11}x^5-2.0700e^{-8}x^4+3.6994e^{-6}x^3-5.4994e^{-5}x^2+6.8025e^{-4}x-1.5077e^{-3}$$

As can be seen from the graph 200, the power transfer function is substantially linear through the middle range of conduction angles. As either small or large conduction angles are approached, the rate of increase in heating power changes at a slower rate. This non-linearity generally does not represent a problem with a heating element load, and can be easily corrected.

The water heater 10 is adapted to reduce the inventory of water heaters in a warehouse or distribution center. More specifically, the heating element 45 of the water heater 10 can be adapted to generate a rated maximum heating output. However, the water heater 10 can be operable to limit the heating output to a defined maximum heating output equal or less than the rated maximum heating output.

For example, water heaters for residential use generally require a maximum wattage and voltage of 5500 watts and 240 volts, respectively. Accordingly, the heating element 45 of the water heater 10 can be manufactured to generate a rated maximum heating output at 5500 watts and 240 volts. For other applications, with heating requirements equal or less than the rated maximum heating output described above, water heaters to fulfill these heating requirements were typically kept in inventory. The invention provides that the water heater 10 can be programmed to generate a defined maximum heating output that is less than the rated maximum heating output (generated at 5000 watts and 240 volts, for example) to reduce the inventory of water heaters, as will be further explained below. Accordingly, a manufacturer needs not to manufacture water heaters with different heating elements for specific applications. The manufacturer needs only to generate the water heater 10 programmable to generate a defined maximum heating output. Thus, the inventory of water heaters can be reduced by having generic water heaters available in the warehouse, where the generic water heaters can be customized through an electronic control (e.g., interface 75). Accordingly, a manufacturer, for example, does not have to stock multiple water heater models configured with unique components, such as heating elements, for each end use requirement.

With reference to FIGS. 2 and 3, the heating element 45 generates a rated maximum heating output when the control circuit 100 relays about 100% of the power supplied by the power source 125 to the heating element 45. Alternatively, the control circuit 100 can be programmed to define a set point A or adjusted turn-on time related to a defined maximum heating output such that the defined maximum heating output is equal or less than the rated maximum heating output. In other words, the control circuit 100 controls the heating element 45 by supplying power related to time delays on or to the left of the set point A with respect to FIG. 3. In the illustrated construction, the control circuit 100 can be programmed via the interface 75 to receive information related to the defined maximum heating output, for example. More particularly, the input/output layer 78 can be adapted to receive a memory stick, a cable (ISB, phone, Ethernet, etc.), or other suitable device to detect a signal indicative of the defined maximum heating output to be generated by the heating element 45. In other constructions, the wireless communication layer 80 is adapted to receive a wireless signal indicative of the defined maximum heating output to be generated by the heating element 45. Accordingly, the interface 75 can send a signal, either via the input/output layer 78 or the wireless communication layer 80, indicating the receipt of the signal first received.

With specific reference to the water heater 10 adapted to reduce inventory, the water heater 10 can be programmed to generate the defined maximum heating output based on information from a data base. For example, a sales representative or technician can program the control circuit 100 via the interface 75 by entering a model number, or other identifier, in the input panel 76. The model number can be related to data stored at the water heater 10, the data defining, among other things, the defined maximum heating output for a known application. Similarly, an Ethernet cable can connect the interface 75 to a portable computer or a handheld device to relay control information, such as the defined maximum heating output, to the water heater 10. In yet another example, the model number or control information can be automatically sent via a router (or similar wireless device) and received by the interface 75 via the wireless communication layer 80. In response to programming the control circuit 100, the controller 50 can generate a signal to confirm the programming operation, send the signal via the input/output layer 78 and/or the wireless communication layer 80, and display such or related information via the display 74. In some other constructions, the interface 75 allows a technician to modify at least a portion of the programming of the controller 50, thereby the technician can control a number of the features of the water heater 10 subsequent to the water heater 10 leaving the control of the manufacturer, seller, or installer.

The interface 75 is further advantageous for at-home maintenance, flexible usage of the water heater, and/or further reduction of inventory. For example, the interface 75 can allow one to enable and/or disable, program, monitor, and operate other features of the water heater 10, such as timers, sensors, alarms, corrosion resistance devices, and others. In one example, a user can program the water heater 10 to operate the water heater 10 in a first mode during a first time period (e.g., weekends) and in a second mode during a second time period (e.g., weekdays). In another example, the user can monitor power consumption of the water heater 10 as well as upload instructions (e.g., operating algorithms) that allow better power management of the water heater 10. In another example, a utility company could be given access to the water heater via the interface 75 to modify the controller 50 and operate the water heater 10 at a lower wattage output during peak load periods. It is envisioned that a user can control the water heater 10 via the interface 75 to adjust the power wattage output to a value different than the power wattage output set at the warehouse or manufacturing facility. It is to be understood that various other features not specifically discussed herein also fall within the scope of the invention.

In one alternative construction of the water heater 10, the control circuit 100 is integrally formed or manufactured with the interface 75. More specifically, the elements of the control circuit 100 can occupy a portion of a circuit board of the interface 75 such that the microcontroller 72 directly monitors and operates the control circuit 100. In another alternative construction of the water heater 10, the operations described above with respect to the control circuit 100 can be performed by the microcontroller 72. For example, the interface 75 can include the microcontroller 72 directly connected to the triac 120 to operate the heating element 45 as described above. In yet other alternative constructions, one or more elements of the control circuit 100, and other elements not specifically described herein, can be integrally formed with the interface 75 allowing the interface 75 to operate the water heater 10 via the microcontroller 72.

The constructions described above and illustrated in the figures are presented by way of example only and are not intended as a limitation upon the concepts and principles of the invention. Various features and advantages of the invention are set forth in the following claims.

What is claimed is:

1. A water heater adaptable to a specific application by setting a defined maximum heating output, the water heater comprising:

a vessel configured to support water to be heated;

an electric heating fixture having a rated maximum heating output based on a characteristic of the electric heating fixture and application of AC power for 180 degrees of each sinusoidal AC half-cycle; and a controller programmed with a value indicative of the defined maximum heating output and configured to control the electric heating fixture to generate no more than the defined maximum heating output by controlling the amount of each sinusoidal AC half-cycle during which AC power is applied to the electric heating fixture, the controller including an interface operable to receive the defined maximum heating output, wherein the defined maximum heating output is determined based on the specific application of the water heater.

2. The water heater as claimed in claim 1, further comprising a temperature sensor connected to the controller and adapted to generate a signal indicative of a temperature related to the water, wherein the controller is operable to control the electric heating fixture to generate a heating output based on the signal.

3. The water heater as claimed in claim 1, wherein the vessel includes a water container for a storage-type water heater.

4. The water heater as claimed in claim 1, wherein the interface includes a wireless interface operable to receive a signal related to the defined heating output, and wherein the controller is operable to determine the defined maximum heating output based on the signal.

5. The water heater as claimed in claim 4, wherein the signal includes an identifier related to the end use features and power output of the water heater.

6. The water heater as claimed in claim 1, wherein the controller includes a sense circuit operable to generate a signal indicative of an AC current.

7. A method of defining application-specific heating capabilities of a water heater suited to a plurality of applications, the method including an electric resistance heating element having a rated maximum heating output and a controller configured to adapt an output of the electric resistive heating element to a specific application, the method comprising:

providing a vessel adapted to support water to be heated with the heating element;

connecting the controller to the heating element; and setting the controller to a defined maximum heating output, including setting the defined maximum heating output for operation of the heating element to be less than the rated maximum heating output, thereby adapting the water heater suited to a plurality of applications to a specific application.

8. The method of claim 7, further comprising receiving a signal indicative of the defined maximum heating output, wherein setting the controller is a result of receiving the signal.

9. The method of claim 8, further comprising wirelessly generating the signal indicative of the defined maximum heating output.

10. The method of claim 8, further comprising generating the signal including a number indicative of the water heater, the number related to the defined maximum heating output.

11. The method of claim 8, further comprising generating a second signal in response to the first signal, the second signal indicative of a confirmation generated as a result of the setting the controller.

12. The method of claim 7, further comprising receiving a signal including instructions for setting the water heater to operate in one of a first mode and a second mode, wherein setting the controller is a result of receiving the signal.

13. The method of claim 12, wherein setting the controller includes configuring the controller with the first mode indicative of a component feature being active.

14. The method of claim 13, wherein the setting the controller includes configuring the controller with the first mode instructing the controller to generate a second signal indicative of a status in response to receiving the signal mentioned first.

15. A method of operating a water heater adapted to a specific end use, the water heater including an electric-resistance heating element having a rated maximum heating output greater than a heat output required for the specific end use, the heating element coupled to a controller configured to control the heating element to a defined maximum heating output equal to the heat output required for the specific end use, the method comprising:

sensing a temperature having a relation to a water temperature;

determining whether to heat the water based on the temperature;

energizing the heating element at the defined maximum heating output based on the determining act; and de-energizing the heating element to an off-state when a water temperature set-point has been attained.

16. The method of claim 15, wherein the determining whether to heat the water includes comparing the sensed temperature to a threshold.

17. The method of claim 15, further comprising sensing a characteristic of the power supplied to the heating element; and calculating a heating output based on the sensed characteristic.

18. The method of claim 17, wherein the sensing the characteristic includes determining the zero-crossings of the power supplied to the heating element.

19. The method of claim 18, wherein the calculating the determined heating output includes determining a turn-on time of a relay fixture connected to the heating element based on the zero-crossings.

20. The method of claim 15, wherein setting the controller includes wirelessly receiving a signal indicative of the defined maximum heating output.

21. The method of claim 15, further comprising generating a signal indicative of confirmation as a result of setting the defining maximum heating output.

22. The method of claim 20, wherein the signal includes a communication originating from a utility company and the defined maximum heating output is based on the communication.

* * * * *